US010654693B2

(12) United States Patent
Furlong

(10) Patent No.: US 10,654,693 B2
(45) Date of Patent: May 19, 2020

(54) CRANE SUPPORT ASSEMBLY

(71) Applicant: Pride Bodies LTD., Cambridge (CA)

(72) Inventor: Geoff Furlong, Cambridge (CA)

(73) Assignee: PRIDE BODIES LTD., Cambridge (CA)

( * ) Notice: Subject to any disclaimer, the term of this patent is extended or adjusted under 35 U.S.C. 154(b) by 1217 days.

(21) Appl. No.: 14/945,637

(22) Filed: Nov. 19, 2015

(65) Prior Publication Data

US 2017/0144870 A1 May 25, 2017

(51) Int. Cl.
*B66C 23/36* (2006.01)
*B66C 23/78* (2006.01)

(52) U.S. Cl.
CPC ..... *B66C 23/36* (2013.01); *B66C 23/78* (2013.01)

(58) Field of Classification Search
CPC ..... B66C 23/16; B66C 23/163; B66C 23/166; B66C 23/36; B66C 23/78
See application file for complete search history.

(56) References Cited

U.S. PATENT DOCUMENTS 2,487,305 A * 11/1949 Bridegroom ..... B66C 23/36 414/543
3,111,226 A 11/1963 Kirsten
3,134,488 A * 5/1964 Brekelbaum ..... B66C 23/26 212/295
3,139,988 A * 7/1964 Brekelbaum ..... B66C 23/90 212/282
3,198,345 A * 8/1965 Brekelbaum ..... B66C 23/26 212/295
3,246,769 A * 4/1966 Noll ..... B66C 23/26 212/295
3,357,572 A * 12/1967 Yoshioka ..... B66C 23/26 212/296
3,545,627 A * 12/1970 Letourneau ..... B66C 23/62 212/303

(Continued)

FOREIGN PATENT DOCUMENTS

CA 1084554 8/1980
CA 1260037 9/1989

(Continued)

*Primary Examiner* — Michael R Mansen
*Assistant Examiner* — Juan J Campos, Jr.
(74) *Attorney, Agent, or Firm* — Christopher R. Carroll; The Small Patent Law Group LLC

(57) ABSTRACT

A crane support system includes two spaced apart longitudinal members couplable with a vehicle frame. Two spaced apart groups of tubes are coupled with and extend between the longitudinal members and outboard relative to one member to define an outboard subassembly portion. A tower frame is mounted atop the outboard subassembly portion. A first brace extends angularly between the groups of tubes, the brace extending from a one of the groups forward relative to the vehicle frame toward the other group aft relative to the vehicle frame and toward the tower frame. A horizontal arm extends transversely beneath the outboard subassembly portion. A vertical support has a top end coupled with the arm and a bottom end couplable with an outrigger. A second brace extends angularly between the vertical support and the arm for transferring bending moment and/or shear from the cantilever to the outrigger via the vertical support.

9 Claims, 6 Drawing Sheets

(56) References Cited

U.S. PATENT DOCUMENTS 3,596,976 A 8/1971 Eitel et al.
3,622,171 A 11/1971 Gottschalk
3,734,302 A * 5/1973 Durand ..... B66C 23/78 212/195
3,817,397 A * 6/1974 Wellman ..... B66C 23/305 212/270
3,856,150 A * 12/1974 Wellman ..... B66C 23/344 212/297
3,934,381 A * 1/1976 Bouma ..... B66C 23/346 52/116
3,934,729 A * 1/1976 Wellman ..... B66C 23/34 212/297
3,938,670 A * 2/1976 Wellman ..... B66C 23/34 212/296
3,939,988 A * 2/1976 Wellman ..... B66C 23/34 212/297
3,944,081 A * 3/1976 Wellman ..... B66C 23/34 212/296
4,059,170 A 11/1977 Young
4,069,922 A * 1/1978 Hawkins ..... B66C 23/42 212/181
4,266,679 A * 5/1981 Juergens ..... B66C 23/78 180/9.1
4,276,985 A 7/1981 Newman
4,419,038 A * 12/1983 Pendergraft ..... B60P 1/5495 212/252
4,570,973 A 2/1986 Ewers et al.
4,616,225 A * 10/1986 Woudenberg ..... E01F 9/662 116/63 P
4,643,320 A * 2/1987 Larsen ..... B66C 23/62 212/180
5,368,317 A 11/1994 McCombs et al.
5,486,084 A * 1/1996 Pitman ..... B60P 1/5433 188/171
6,007,289 A * 12/1999 Kruse ..... A61G 3/0209 414/462
7,111,744 B2 * 9/2006 Brannan ..... B60P 1/5404 212/180
7,328,810 B1 2/2008 Rhodes
7,503,414 B2 3/2009 Pierce et al.
7,762,616 B2 7/2010 Smith et al.
9,484,602 B1 * 11/2016 Podolefsky ..... E02F 9/26
2007/0001421 A1 1/2007 Pierce et al.
2008/0182624 A1 * 7/2008 Newman ..... H01Q 1/1235 455/561
2011/0061336 A1 * 3/2011 Thomas ..... B66C 23/342 52/745.19
2011/0207097 A1 * 8/2011 Lumry ..... G09B 23/183 434/219
2014/0158656 A1 * 6/2014 Pembleton ..... B66C 23/16 212/296
2014/0260076 A1 * 9/2014 Yustus ..... E04H 12/344 52/745.18
2014/0264215 A1 * 9/2014 Yustus ..... E04H 12/344 254/93 R
2014/0370935 A1 * 12/2014 Newman ..... H01Q 1/1235 455/562.1
2017/0349419 A1 * 12/2017 Lee ..... B63B 9/06
2018/0022420 A1 * 1/2018 Lee ..... B66C 23/18 29/469
2018/0201175 A1 * 7/2018 Kennedy ..... B60P 3/18
2018/0282135 A1 * 10/2018 Konijn ..... B66C 23/26
2019/0247687 A1 * 8/2019 Hren ..... A62C 27/00

FOREIGN PATENT DOCUMENTS

CN 202346658 7/2012
CN 203531005 4/2014

* cited by examiner

CRANE SUPPORT ASSEMBLY

TECHNICAL FIELD

The present disclosure relates to a crane support assembly for mounting a crane system to a utility vehicle and more specifically to a crane support assembly, which provides increased support against operational forces acting on the crane system.

BACKGROUND

Crane systems may be mounted to a utility vehicle such as a truck for transport of the crane system to a work site and for location and deployment of the crane system at the work site. Mobile cranes generally operate a telescopic boom mounted by a crane tower assembly to a support assembly. The support assembly is coupled with the vehicle frame for supporting the crane tower assembly and for providing rigid support against operational forces while the crane is deployed. The operational forces may be great when the boom is fully extended and when the crane is operating at or near maximum load capacity. Cranes also benefit from support across a range of angles relative to the vehicle body. Vehicle-mounted cranes may also include an outrigger assembly which has legs that are extendable telescopically from the rear or sides of the vehicle. The outrigger provides additional stability and support against forces acting on the crane.

Vehicle-mounted crane systems may have load capacities in the range of tens of thousands of foot-pounds. However, support systems for the crane system are fabricated from heavy rigid materials such as steel in order to provide resistance to operational forces acting on the crane. This results in a need for heavier vehicles on which to mount and transport the crane system. Heavier vehicles are larger and more expensive to produce.

Accordingly, there is a demand for crane support systems which have high load capacity and which may be mounted on and transported using smaller vehicles and subsequently deployed for operation while mounted to the smaller vehicle.

BRIEF DESCRIPTION

The present disclosure relates to a crane support assembly for mounting a crane system to a utility vehicle and more specifically to a crane support assembly which provides increased support against operational forces acting on the crane system.

In one aspect, there is provided a crane tower assembly including a crane tower frame mountable atop at least one support subassembly member which is couplable with at least one longitudinal channel of a vehicle frame for supporting the crane tower frame outboard relative to the at least one longitudinal channel of the vehicle frame. The crane tower assembly also includes a horizontal arm couplable with the at least one support subassembly member outboard relative to the vehicle frame from beneath the at least one support subassembly member and transversely relative to the at least one support subassembly member, a vertical support having a top end portion coupled with the horizontal arm and a bottom end portion couplable with an outrigger assembly, and a rigid brace extending angularly between the vertical support and the horizontal arm for supporting the horizontal arm and for transferring at least one of bending moment and shear acting on the horizontal arm during crane operation to the outrigger assembly via the vertical support.

The crane tower assembly may include a bracket couplable between the bottom end portion of the vertical support and the outrigger assembly for rigidly coupling the vertical support with the outrigger assembly. The bracket may include a vertically extending outrigger coupling portion for coupling the bracket with the outrigger assembly and a horizontally extending support portion extending perpendicularly from the outrigger coupling portion and couplable with the bottom end portion of the vertical support from beneath the bottom end portion of the vertical support.

The crane tower frame may further comprise two pair of vertically extending corner members, each corner member having a bottom corner member end portion and a top corner member end portion. The bottom corner member end portion of each vertically extending corner member of each pair at vertically extending corner members is couplable with the at least one support subassembly member. At least one horizontal member may extend between each vertically extending corner member of each pair of vertically extending corner members. At least one horizontal brace may extend between the at least one horizontal member of each pair of vertically extending corner members.

In another aspect, there is provided a crane tower support subassembly including two parallel spaced apart longitudinally extending members couplable with a vehicle frame. The crane tower support subassembly also includes two spaced apart groups of parallel rigid tubes coupled with the two parallel spaced apart longitudinally extending members and extending between the two parallel spaced apart longitudinally extending members and outboard relative to one of the two parallel spaced apart longitudinally extending members to define an outboard support subassembly portion for supporting a crane tower assembly. A brace extends angularly between each of the two groups of parallel tubes. The brace is coupled with at least one tube of each of the two groups of parallel rigid tubes for extending from a one of the two groups of parallel rigid tubes forward relative to the vehicle frame toward another one of the two groups of parallel rigid tubes aft relative to the vehicle frame and toward the crane tower assembly. During crane system operation, it is preferable that the forces acting on the two groups of parallel rigid tubes are limited to bending moment and shear forces. The brace restricts relative movement between the two groups of parallel rigid tubes and in particular restricts longitudinal movement of one of the two spaced apart groups of parallel rigid tubes relative to the other one of the two spaced apart groups of parallel rigid tubes during crane system operation in a direction transverse relative to the two longitudinally extending members. This in turn restricts unwanted bending forces from being transferred to the vehicle frame during crane system operation.

A horizontal support member may be coupled with the outboard support subassembly portion parallel relative to the longitudinally extending members. The horizontal support member may extend between the two spaced apart groups of parallel rigid tubes of the outboard support subassembly portion and may be spaced apart from the one of the two parallel spaced apart longitudinally extending members for supporting at least a portion of the crane tower assembly.

The two spaced apart groups of parallel rigid tubes may include a forward group of parallel rigid tubes and an aft group of parallel rigid tubes. A forwardmost tube of the forward group of parallel rigid tubes and an aftmost tube of the aft group of parallel rigid tubes may extend outboard relative to the other one of the two parallel spaced apart longitudinally extending members for each supporting at least one component of a vehicle. The forwardmost tube of the forward group of parallel rigid tubes of the outboard support subassembly portion and the aftmost tube of the aft group of parallel rigid tubes of the outboard support subassembly portion may also be longer than other tubes of the forward group of parallel rigid tubes and the aft group of parallel rigid tubes.

The two groups of parallel rigid tubes, the brace, and the two parallel spaced apart longitudinally extending members may be coplanar and may each be formed from rigid tubes having the same dimensions in cross-section.

In yet another aspect, there is provided a crane tower support system including two parallel spaced apart longitudinally extending members couplable with a vehicle frame and two spaced apart groups of parallel rigid tubes coupled with the two parallel spaced apart longitudinally extending members and extending between the two parallel spaced apart longitudinally extending members and outboard relative to one of the two parallel spaced apart longitudinally extending members to define an outboard support subassembly portion. A crane tower frame is mounted atop the outboard support subassembly portion. A first brace extends angularly between each of the two groups of parallel tubes, the first brace is coupled with at least one tube of each of the two groups of parallel rigid tubes for extending from a one of the two groups of parallel rigid tubes forward relative to the vehicle frame toward another one of the two groups of parallel rigid tubes aft relative to the vehicle frame and toward the crane tower frame. The first brace restricts relative movement between the two groups of parallel rigid tubes and in particular restricts longitudinal movement of one of the two spaced apart groups of parallel rigid tubes relative to the other one of the two spaced apart groups of parallel rigid tubes during crane system operation in a direction transverse relative to the two longitudinally extending members. This in turn restricts unwanted bending forces from being transferred to the vehicle frame during crane system operation. A horizontal arm is coupled with and extends transversely relative each of the two groups of parallel rigid tubes of the outboard support subassembly portion from beneath the outboard support subassembly portion. A vertical support has a top end portion coupled with the horizontal arm and a bottom end portion couplable with an outrigger assembly. A rigid second brace extends angularly between the vertical support and the horizontal arm for supporting the horizontal arm and for transferring at least one of bending moment and shear acting on the horizontal arm during crane operation to the outrigger assembly via the vertical support.

The two spaced apart groups of parallel rigid tubes with the first brace extending therebetween provide a rigid structure upon which the crane tower assembly may be mounted. The crane tower support subassembly provides rigid support for the load of the crane tower assembly itself as well as the crane system including a crane boom which is to be mounted to the crane tower assembly. The crane tower support subassembly also provides rigid support against operational forces acting on the crane system during crane system operation. However, when operating at or near maximum load capacity, the crane tower subassembly may be subject to bending moment forces, shear forces, or other forces associated with the operation of the crane system.

The coupling of the horizontal arm beneath and transversely relative to the two spaced apart groups of parallel rigid tubes of the outboard support subassembly portion, the coupling of the vertical support with the outrigger assembly and the rigid brace together provide a means for transferring at least one of bending moment and shear forces acting on the crane tower subassembly to the outrigger assembly. Forces acting on the crane tower support subassembly are transferred to the horizontal arm and to the vertical support by way of the horizontal arm coupling with the top end portion of the vertical support and the rigid brace also coupled with the vertical support. Since the vertical support is rigidly coupled with the outrigger assembly, forces acting on the horizontal arm are transferred to the outrigger assembly. Accordingly, at least some of the load on the crane support system before, during, or after crane system operation may be transferred to the outrigger assembly.

BRIEF DESCRIPTION OF THE DRAWINGS

For a better understanding of the nature and objects of the present invention reference may be had by way of example to the accompanying diagrammatic drawings in which.

DETAILED DESCRIPTION

The present disclosure relates to a crane support assembly for mounting a crane system to a utility vehicle and more specifically to a crane support assembly which provides increased support against operational forces acting on the crane system.

Figure 1:
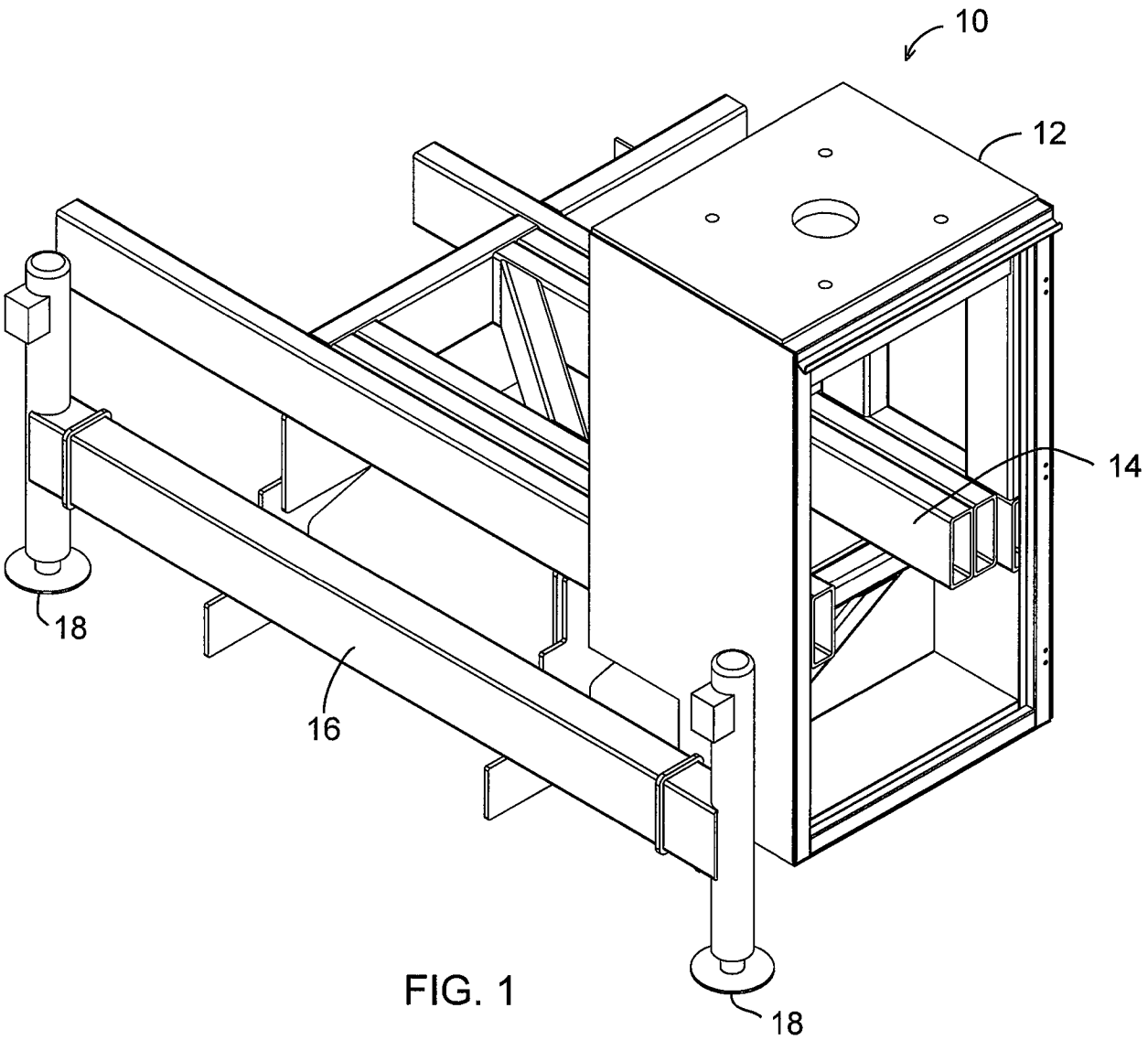
FIG. 1 is a perspective view of the crane support system.
Figure 2:
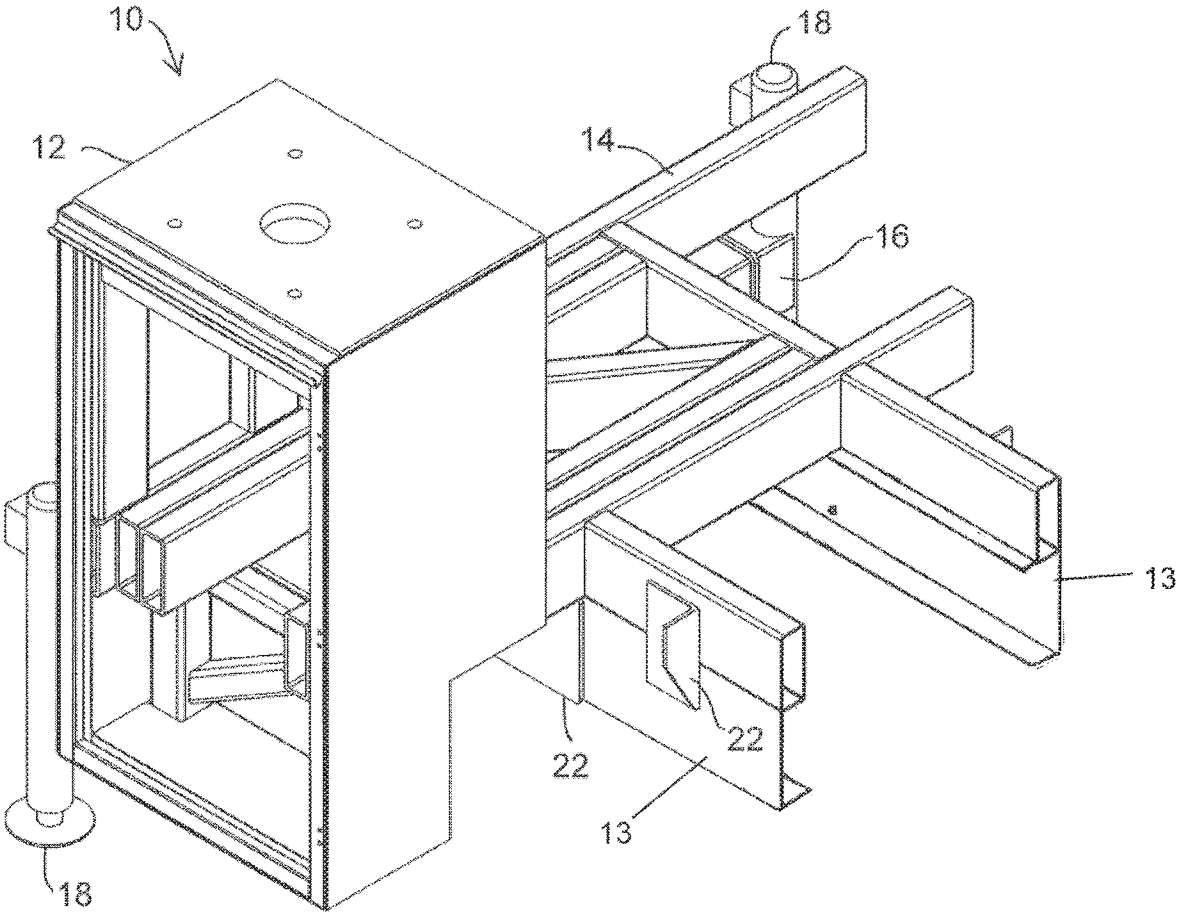
FIG. 2 is a perspective view of the crane support system.

As shown in FIGS. 1 and 2, the crane support system 10 includes a crane tower assembly 12 and a crane tower support subassembly 14. The crane tower assembly 12 and the crane tower support subassembly 14 may be coupled together to support a crane system (not shown) which may be mounted on top of the crane tower assembly 12. The crane support system 10 may be mounted to a vehicle frame or chassis (not shown) for transporting the crane system to and from work sites. The crane support system 10 may be coupled with outrigger assembly 16. Outrigger assembly 16 is shown in FIGS. 1 and 2 coupled with the crane support system 10 in a non-deployed state for transportation. Legs 18 of outrigger assembly 16 may be telescopically extended during crane operation for engagement with the ground surrounding the vehicle in order to provide greater stability to the crane system during crane system operation.

Figure 3:
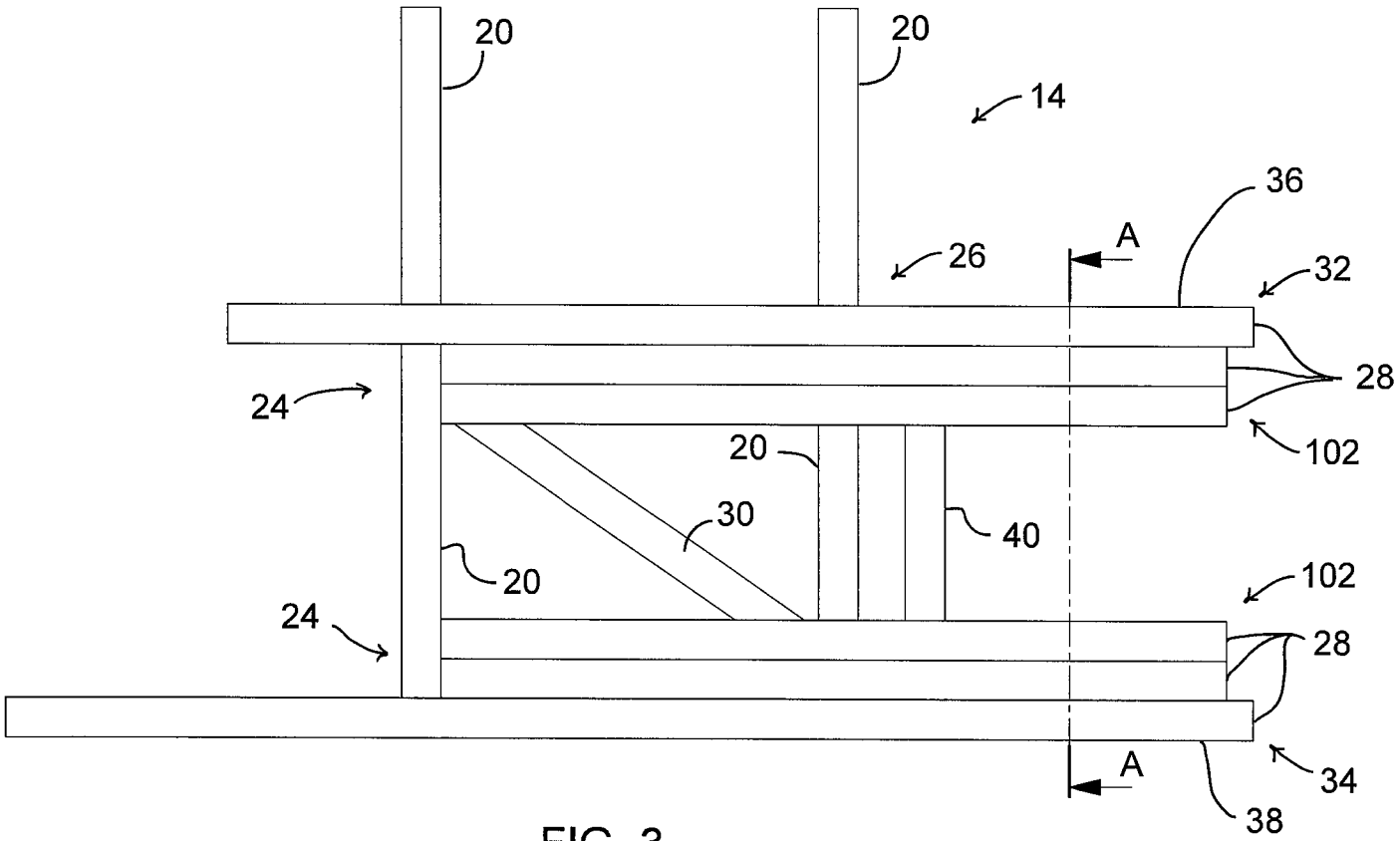
FIG. 3 is a top down view of the crane support subassembly.

The crane tower support subassembly 14 is shown in greater detail in FIG. 3. The crane tower support subassembly 14 includes two parallel spaced apart longitudinally extending members 20 which may be coupled with the vehicle frame. Preferably, the vehicle frame includes two parallel spaced apart vehicle frame members 13, as shown in FIG. 2, which extend longitudinally from the forward end of the vehicle to the rear. Preferably each one of the two parallel spaced apart longitudinally extending members 20 of the crane tower support subassembly 14 is coupled with a corresponding one of the two parallel spaced apart vehicle frame members 13. As shown in FIG. 2, such a coupling may be facilitated by brackets 22 which may couple one of the two parallel spaced apart longitudinally extending members 20 with a corresponding one of the two parallel spaced apart vehicle frame members. For example, brackets 22 may be bolted between the parallel spaced apart longitudinally extending members 20 and a corresponding one of the two parallel spaced apart vehicle frame members 13.

The crane tower support subassembly 14 also includes at least two spaced apart horizontal support subassembly members preferably in the form of two spaced apart groups of parallel rigid tubes 24 coupled with the two parallel spaced apart longitudinally extending members 20. The two spaced apart groups of parallel rigid tubes 24 extend between the two parallel spaced apart longitudinally extending members 20 and outboard relative to one of the two parallel spaced apart longitudinally extending members 20 to define an outboard support subassembly portion 26. In a manner described further herein, the crane tower assembly 12 may be mounted atop the outboard support subassembly portion 26. Each of the two spaced apart groups of parallel rigid tubes 24 shown in FIG. 3 include three parallel rigid tubes 28. It should be understood that two or more parallel rigid tubes 28 may be used in each of the two spaced apart groups of parallel rigid tubes 24. The parallel rigid tubes 28 are preferably coupled together such as by welding, for example, in order to provide further rigidity to the outboard support subassembly portion 26 and thereby providing rigid support for the crane tower assembly 12 and further resistance to crane system operational forces.

Of the two spaced apart groups of parallel rigid tubes 24, one of the two spaced apart groups of parallel rigid tubes 24 is further forward relative to the vehicle frame than the other one of the two spaced apart groups of parallel rigid tubes 24 which is further aft relative to the vehicle frame. A brace 30 extends angularly between the forward group of parallel rigid tubes 32 toward the aft group of parallel rigid tubes 34 and toward the outboard support subassembly portion 26. The brace 30 provides further rigidity to the crane tower support subassembly 14 and also provides further resistance to forces acting on the crane tower support subassembly 14 such as for example bending moment and shear stresses which may arise during crane operation. During crane system operation, it is preferable that the forces acting on the two groups of parallel rigid tubes 24 are limited to bending moment and shear forces. The brace 30 restricts relative movement between the two groups of parallel rigid tubes 24 and in particular restricts longitudinal movement of one of the two spaced apart groups of parallel rigid tubes 24 relative to the other one of the two spaced apart groups of parallel rigid tubes 24 during crane system operation in a direction transverse relative to the two longitudinally extending members 20. This in turn restricts unwanted bending forces from being transferred to the vehicle frame during crane system operation.

Figure 4:
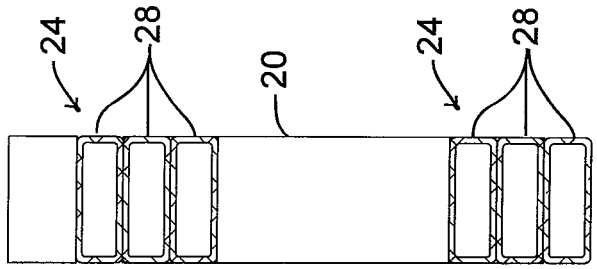
FIG. 4 is a cross section view of the two groups of parallel rigid tubes shown in FIG. 3, taken along line A-A.

In one preferred aspect shown in FIG. 4, all of the parallel rigid tubes of the two spaced apart groups of parallel rigid tubes 24 may be rectangular in cross-section and have the same dimensions in width and height. The tubes may be fabricated from any rigid material. However the tubes are preferably fabricated from aluminum and are preferable 3" by 8" rectangular tubes. Moreover the tubes of each of the two spaced apart groups of parallel rigid tubes 24 are preferably welded together by stitch welding. Stitch welding limits or reduces the amount of heat put into the tubes during welding which in turn reduces weakening or deformation of the structure of the tubes as a result of the welding operation. Moreover, stitch welding reduces the materials used and time required and hence the overall cost of the welding operation when compared to continuous welding along the length of the tubes.

Figure 5:
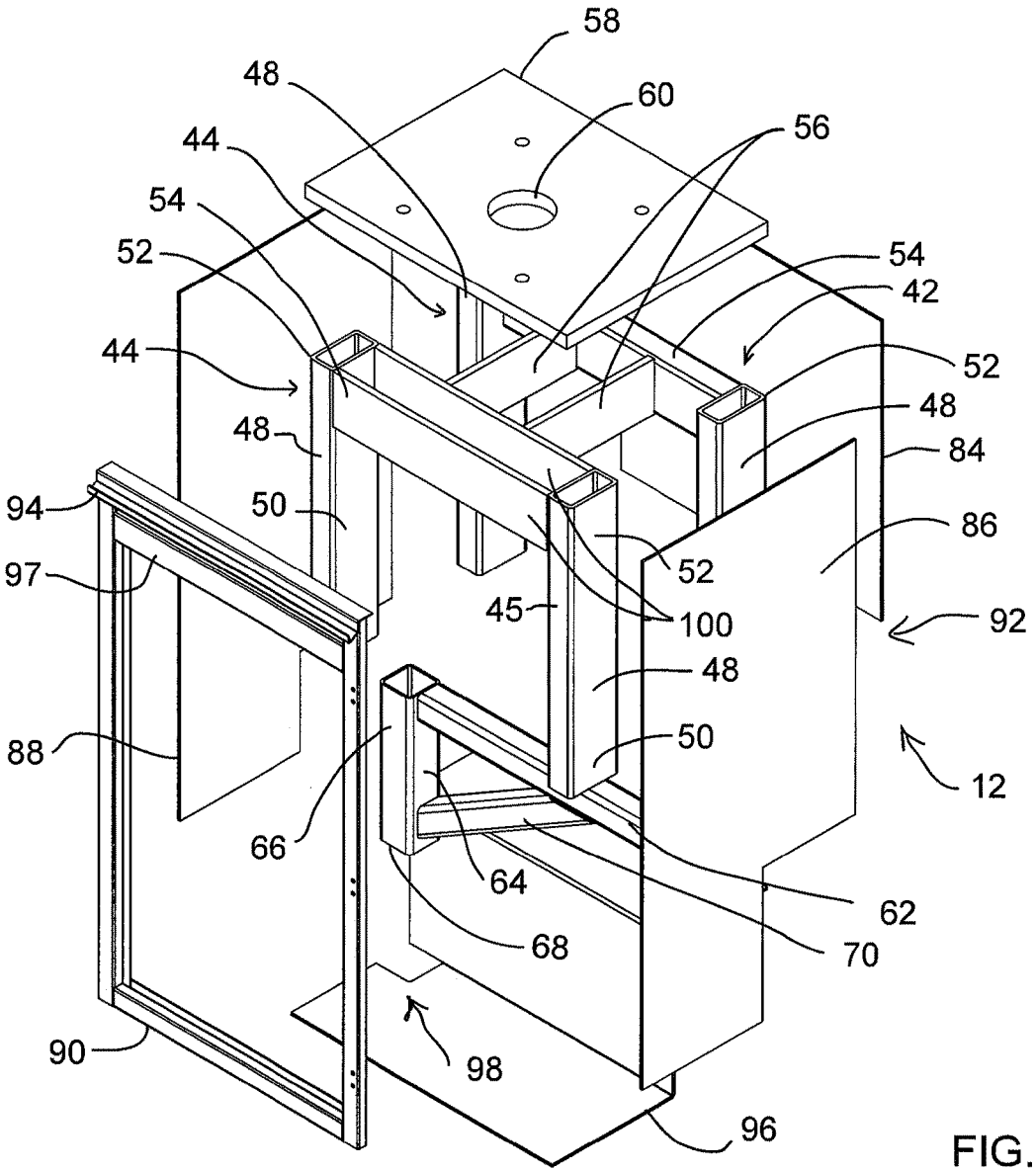
FIG. 5 is an exploded view of the crane tower assembly.

The crane tower assembly 12 is shown in greater detail in FIG. 5. The crane tower assembly 12 includes a crane tower frame 42 which may include two pair 44 of vertically extending corner members 48. Each corner member 48 has a bottom corner member end portion 50. Each vertically extending corner member 48 of each pair 44 of the vertically extending corner members 48 is coupled with a corresponding one of the two spaced apart groups of parallel rigid tubes 24 of the outboard support subassembly portion 26 to mount the crane tower frame 42 atop the outboard support subassembly portion 26. Each vertically extending corner member 48 also has a top corner member end portion 52. At least one horizontal member 54 extends between each top corner member end portion 52 of the vertically extending corner members 48 of each pair 44 of vertically extending corner members 48. The at least one horizontal member 54 extending between each vertically extending corner member 48 of one pair 44 of vertically extending corner members 48, may include two spaced apart spacer bars 100. Preferably, spacer bars 100 extend between the vertically extending corner members 48 of the outboard pair 45 of vertically extending corner members 48. Spacer bars 100 are preferably flat bars which allow for access to bolts (not shown) for coupling door 90 with the crane tower frame 42. A crane plate 58 having a crane plate opening 60 extending there through may be mounted atop and supported by the two pair 44 of vertically extending corner members 48. Spacer bars 100 and the crane plate 58 form a C-shaped channel. At least one horizontal brace 56 may extend between the at least one horizontal member 54 extending between the vertically extending corner members 48 of each pair 44 of vertically extending corner members 48. FIG. 5 includes two such horizontal braces 56. Horizontal braces 56 are also preferably flat bars similar to spacer bars 100. This allows clearance for rear bolts (not shown) of the crane system when the crane system is mounted to crane plate 58 and also allows access to the rear bolts of the crane system. Horizontal braces 56 also support the crane plate 58 during crane system operation such as for example when the crane boom is rotated about the crane plate 58.

Crane tower assembly 12 may also include a rear panel 84 a first side panel 86 a second side panel 88 and a door 90 coupled with the vertically extending corner members or aides to form a crane tower housing 92 the interior of the crane tower housing 92 is accessible via the door 90. A drip tray 94 is coupled with a top edge portion 97 of the door 90. The drip tray 94 redirects water or other fluids or debris away from the door 90. The crane tower housing 92 may also include a bottom plate 96 coupled with bottom portions of each of the rear panel 84, the first side panel 86, the second side panel 88 and the door 90. Bottom plate 96 has an opening 98 passing therethrough. Vertical support 64 passes through the bottom plate 96 via the opening 98.

With further reference to FIG. 3, a forwardmost tube 36 of the forward group of parallel rigid tubes 32 and an aftmost tube 38 of the past group of parallel rigid tubes 32 may extend outboard relative to the other one of the two parallel spaced apart longitudinally extending members 20 or outboard on the non-crane side of the support subassembly 14. The forwardmost tube 36 outboard relative to the other one of the two parallel spaced apart longitudinally extending members 20 extends beneath a compartment (not shown) to support the compartment. The aftmost tube 38 outboard relative to the other one of the two parallel spaced apart longitudinally extending members 20 extends out to the extent of the vehicle and structurally ties the rear end of the vehicle with the support subassembly 14.

The forwardmost tube 36 and the aftmost tube 38 of the outboard support subassembly portion 26 may also be longer than the other tubes of the forward group of parallel rigid tubes 32 and the aft group of parallel rigid tubes 34 forming the outboard support subassembly portion 26. The greater length of the forwardmost tube 36 and aftmost tube 38 relative to the other tubes of the forward and aft groups of parallel rigid tubes 32 provides a space or cutaway portion 102 which may be occupied by the door 90 and any associated hardware when it is in a closed or nearly closed position.

Figure 8:
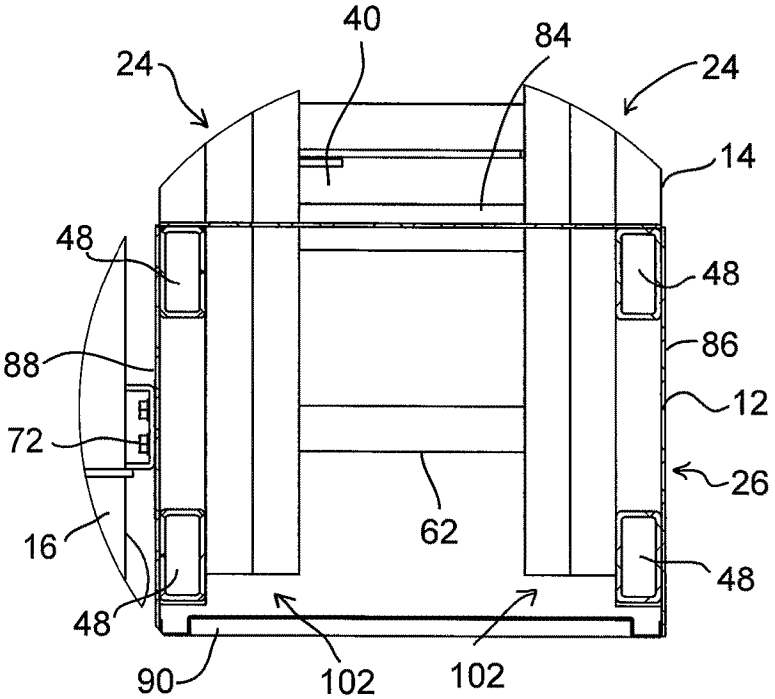
FIG. 8 is a top down view of the crane tower assembly coupled with the crane tower support subassembly and the outrigger assembly; and, FIG. 9 is a side view of the crane tower assembly coupled with the crane tower support subassembly and the outrigger assembly.

Also shown in FIG. 3 is a horizontal support member 40 which may also be coupled with the outboard support subassembly portion 26 parallel relative to the parallel longitudinally extending members 20. The horizontal support member 40 is spaced apart from the nearest one of the parallel longitudinally extending members 20 and extends between the two spaced apart groups of parallel rigid tubes 24 of the outboard support subassembly portion 26. The horizontal support member 40 is coupled with each of the two innermost members of the two spaced apart groups of parallel rigid tubes 24. As shown in FIG. 8, rear panel 84 and horizontal support member 40 are parallel relative to one another and the horizontal support member 40 supports the rear panel 84 of the crane tower assembly housing 92 from beneath the rear panel 84.

Returning to FIG. 5, the crane tower assembly 12 also includes a horizontal arm 62 which is coupled with the outboard support subassembly portion 26 from beneath the outboard support subassembly portion 26 and transversely relative to the two spaced apart groups of parallel rigid tubes 24. The crane tower assembly 12 further includes a vertical support 64. Vertical support 64 has a top end portion 66 and a bottom end portion 68. The top end portion 66 is coupled with horizontal arm 62. The bottom end portion 68 may be coupled with outrigger assembly 16. A rigid brace 70 extends angularly between the vertical support 64 and the horizontal arm 62 to rigidly support the horizontal arm 62.

Figure 7:
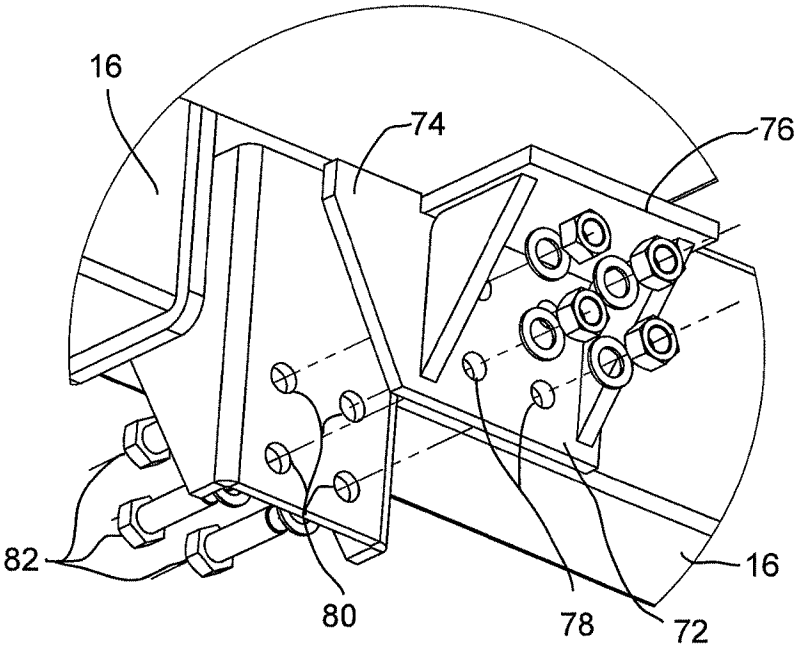
FIG. 7 is a perspective view of the crane tower assembly bracket and the outrigger assembly.
Figure 6:
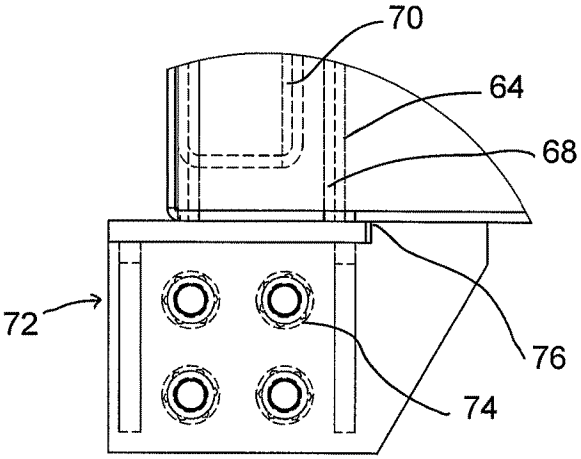
FIG. 6 is a side view of the crane tower assembly bracket.

The coupling of the bottom end portion 68 of vertical support 64 is shown in greater detail in FIGS. 5 and 6. Preferably, a bracket 72 is coupled with the bottom end portion 68 of the vertical support 64 and with the outrigger assembly 16 for rigidly coupling the vertical support 64 with the outrigger assembly 16. The bracket 72 includes a vertically extending outrigger coupling portion 74 for coupling the bracket 72 with outrigger assembly 16 and also includes a horizontally extending rigid support shelf 76 extending perpendicularly from the outrigger coupling portion 74. The bottom end portion 68 of vertical support 64 is coupled with or, preferably, mounted on top of the horizontally extending rigid support shelf 76. As shown in FIGS. 6 and 7, a plurality of apertures 78 extends through the outrigger coupling portion for alignment with a plurality of corresponding aperture is 80 in the outrigger assembly 16. When the apertures 78 and the corresponding apertures 80 are aligned, a fastener 82 such as a bolt or rivet for example, may pass through the outrigger coupling portion 74 and the outrigger assembly 16 for coupling the bracket 72 relative to the outrigger assembly 16. Accordingly, there is provided a rigid support upon which the vertical support 64 may be mounted. It should be understood that bracket 72 may have other configurations provided that the bracket couples the vertical support 64 with the outrigger assembly 16.

Figure 9:
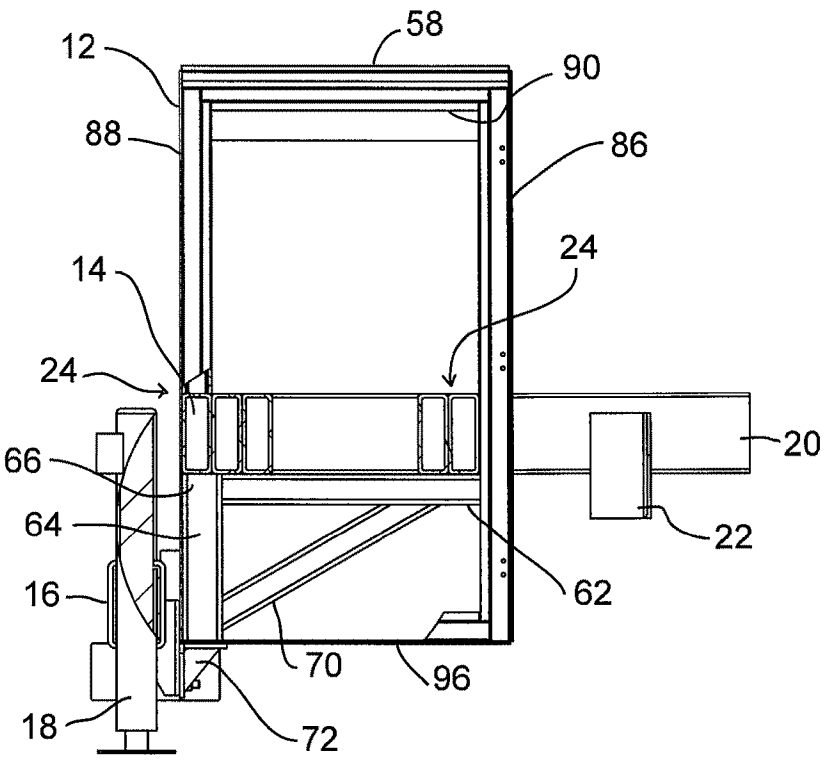

FIGS. 8 and 9 show the crane tower assembly 12 coupled with the crane tower support subassembly 14 and the outrigger assembly 16. The crane tower support subassembly 14 with the two spaced apart groups of parallel rigid tubes 24 and the brace 30 provide a highly rigid structure upon which the crane tower assembly 12 may be mounted. The crane tower support subassembly 14 provides rigid support for the load of the crane tower assembly 12 as well as the crane system including the crane boom which is to be mounted to the crane tower assembly 12. The crane tower support subassembly 14 also provides rigid support against operational forces acting on the crane system during crane system operation. However, when operating at or near maximum load capacity, the crane tower support subassembly 14 may be subject to bending moment forces, shear forces, or other forces associated with the operation of the crane system. The coupling of the horizontal arm 62 beneath and transversely relative to the two spaced apart groups of parallel rigid tubes 24 of the outboard support subassembly portion 26, the coupling of the vertical support 64 with the outrigger assembly 16 and the rigid brace 70 together provide a means for transferring bending moment acting on the crane tower support subassembly 14 to the outrigger assembly 16. Forces acting on the crane tower support subassembly 14 are transferred to the horizontal arm 62 which in turn are transferred to the vertical support 64 by way of the horizontal arm coupling with the top end portion 66 of the vertical support 64 and the rigid brace 70 also coupled with the vertical support 64. Since the vertical support 64 is rigidly coupled with the outrigger assembly 16 by way of bracket 72, forces acting on the horizontal arm 62 are transferred to the outrigger assembly 16. Accordingly, at least some of the load on the crane support system before, during, or after crane operation may be transferred to the outrigger assembly 16.

While there have been described herein what are considered to be preferred and exemplary aspects of the present invention, other modifications of these aspects falling within the invention described herein shall be apparent to those skilled in the art.

What is claimed is:

1. A crane tower assembly comprising:

a crane tower frame mountable atop at least two spaced apart horizontal support subassembly members for supporting the crane tower frame outboard relative to at least one longitudinally extending member of a vehicle frame, the at least two spaced apart horizontal support subassembly members configured for coupling with the at least one longitudinally extending member of the vehicle frame;

a horizontal arm coupled with the at least two spaced apart horizontal support subassembly members outboard relative to the at least one longitudinally extending member of the vehicle frame from beneath the at least two spaced apart horizontal support subassembly members and transversely relative to the at least two spaced apart horizontal support subassembly members;

a vertical support having a top end portion coupled with the horizontal arm and a bottom end portion couplable with an outrigger assembly; and, a rigid brace extending angularly between the vertical support and the horizontal arm for supporting the horizontal arm and for transferring at least one of bending moment and shear acting on the horizontal arm during crane operation to the outrigger assembly via the vertical support.

2. The crane tower assembly as in claim 1, further comprising:

a bracket couplable between the bottom end portion of the vertical support and the outrigger assembly for rigidly coupling the vertical support with the outrigger assembly.

3. The crane tower assembly as in claim 2, wherein the bracket further comprises:

a vertically extending outrigger coupling portion for coupling the bracket with the outrigger assembly; and, a horizontally extending support portion extending perpendicularly from the outrigger coupling portion and couplable with the bottom end portion of the vertical support from beneath the bottom end portion of the vertical support.

4. The crane tower assembly as in claim 3, wherein the bracket further comprises:

at least one aperture extending through the outrigger coupling portion for alignment with at least one corresponding aperture in the outrigger assembly, the at least one aperture and the at least one corresponding aperture, when aligned, providing passage for a fastener from the outrigger coupling portion to the outrigger assembly for coupling the bracket with the outrigger assembly.

5. The crane tower assembly as in claim 1, wherein the crane tower frame further comprises:

two pairs of vertically extending corner members, each corner member having a bottom corner member end portion and a top corner member end portion, the bottom corner member end portion of each vertically extending member of each pair of vertically extending corner members is couplable with a corresponding one of the at least two spaced apart horizontal support subassembly members; and, at least one horizontal member extending between each top corner member end portion of the vertically extending corner member of each pair of vertically extending corner members.

6. The crane tower assembly as in claim 5, further comprising:

at least one horizontal brace extending between the at least one horizontal member of each pair of vertically extending corner members.

7. The crane tower assembly as in claim 5, further comprising:

a crane plate mounted atop and supported by the two pair of vertically extending corner members.

8. The crane tower assembly as in claim 5, wherein:

the at least one horizontal member extending between each vertically extending corner member of one pair of vertically extending corner members includes two spacer bars.

9. The crane tower assembly as in claim 5, further comprising:

a bottom plate having an opening passing therethrough for passage of the vertical support.

* * * * *